United States Patent [19]

Bartels

[11] 4,165,004

[45] Aug. 21, 1979

[54] INWARD EMBOSSED PANEL ADJACENT TO PUNCHED POUR HOLE IN TOP END UNIT

[75] Inventor: Herbert D. Bartels, Palos Heights, Ill.

[73] Assignee: The Continental Group, Inc., New York, N.Y.

[21] Appl. No.: 934,569

[22] Filed: Aug. 17, 1978

[51] Int. Cl.[2] ..... B65D 17/16

[52] U.S. Cl. ..... 206/631; 220/359; 229/7 R

[58] Field of Search ..... 206/633, 631; 229/7 R, 229/17 R, 7 S, 48 SB; 220/260, 359; 215/232

[56] References Cited

U.S. PATENT DOCUMENTS

| | | | |
|---|---|---|---|
| 585,645 | 7/1897 | Achenbach | 229/7 R |
| 2,738,916 | 3/1956 | Peters | 229/48 SB |
| 3,326,450 | 6/1967 | Langdon | 206/633 |
| 3,724,651 | 4/1973 | Link | 206/633 |
| 3,854,653 | 12/1974 | Engelsberger | 206/633 |
| 3,889,844 | 6/1975 | Viker et al. | 229/7 R |
| 3,908,857 | 9/1975 | Chiappe | 229/7 R |

FOREIGN PATENT DOCUMENTS

| | | | |
|---|---|---|---|
| 521898 | 8/1953 | Belgium | 229/7 R |
| 1011360 | 6/1952 | France | 229/7 R |
| 1392851 | 2/1965 | France | 229/7 R |
| 402729 | 5/1966 | Switzerland | 229/7 R |
| 393199 | 6/1933 | United Kingdom | 229/7 R |

*Primary Examiner*—Stephen P. Garbe
*Attorney, Agent, or Firm*—Charles E. Brown

[57] ABSTRACT

An easy opening container construction wherein a pull tape is detachably bonded in a prescribed pattern to a container wall surrounding one or more dispensing openings. The configuration of the detachable bond or seal is accurately controlled by raising the container wall in the area of the detachable bond to the desired bond configuration. By so controlling the configuration of the detachable bond, the bond configuration remains the same, notwithstanding changes in operating conditions during the formation of the bond.

11 Claims, 7 Drawing Figures

INWARD EMBOSSED PANEL ADJACENT TO PUNCHED POUR HOLE IN TOP END UNIT

This invention relates in general to new and useful improvements in container construction, and more particularly to containers of the easy opening type.

It is known to form one or more apertures in a container wall portion for the purpose of dispensing a product and to seal those apertures temporarily by way of a pull tape. Such pull tape is customarily of a laminated construction including a metal foil and a plastics material film. Bonding of the pull tape to the container wall portion surrounding the openings is effected by means of a pressure die with the bonding pattern being defined by the contact between the pressure die and the pull tape as supported by the container wall portion. Existing systems for adhesive pull tape applications depend solely on the dimensions incorporated in the sealing dies. Due to variations in the thickness of the pull tape, pressure, temperature and employment of post heating, the sealing bond width may increase thus providing an undesirable increase in peel force required to remove the pull tape.

Easy opening containers of the known prior art, but without an adhesion pattern, are disclosed in the patent to Chiappe, U.S. Pat. No. 3,908,857.

In accordance with this invention, it is proposed accurately to control the seal pattern between the pull tape and the container wall portion by raising a part of the container wall above the adjacent container wall areas for contact with the pull tape under the influence of a sealing die. In this way, the same sealing pattern can be repeatedly obtained even with variations in operating conditions.

In one embodiment of the invention, the container wall portion is inwardly recessed in an area of the dispensing openings and then is elevated or raised back to its original height in the seal area surrounding the dispensing openings to the desired sealing pattern. In another form of the invention, the container wall portion is raised surrounding the dispensing opening while the material of the container wall portion in which the dispensing opening is inwardly formed is not elevated.

It is to be understood that the raised areas may be varied in configuration to obtain different seal patterns and thereby different peel resistance.

With the above and other objects in view that will hereinafter appear, the nature of the invention will be more clearly understood by reference to the following detailed description, the appended claims, and the several views illustrated in the accompanying drawings.

Figure 1:
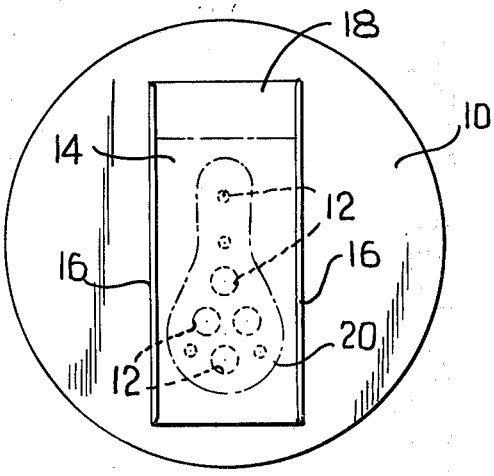
FIG. 1 PRIOR ART
FIG. 1 is a plan view of a portion of a container wall having dispensing openings therein sealed by a pull tape in accordance with the prior art.

Referring now to the drawings in detail, reference is first made to the prior art showing of FIG. 1 wherein a container wall portion 10 has a plurality of dispensing openings 12 formed therein in a prescribed pattern. The dispensing openings 12 are sealed for handling and storage by way of an adhesive tape or pull tape 14 which may be of any acceptable construction and is normally in the form of a laminate including a metal foil layer and a plastics material film layer. Edges of the tape 14 are reversely turned as at 16 to reinforce the tape.

The pull tape has a permanent bond 18 with the container wall portion 10 at the rear end thereof. It further has a detachable bond 20 with the container wall portion 10 in a selected pattern around the dispensing openings 12. The pattern of the detachable bond is controlled by a sealing die (not shown) and varies, as described above, with variations in operating conditions.

This invention relates to a means for effectively sealing the configuration of the detachable bond 20.

Figure 2:
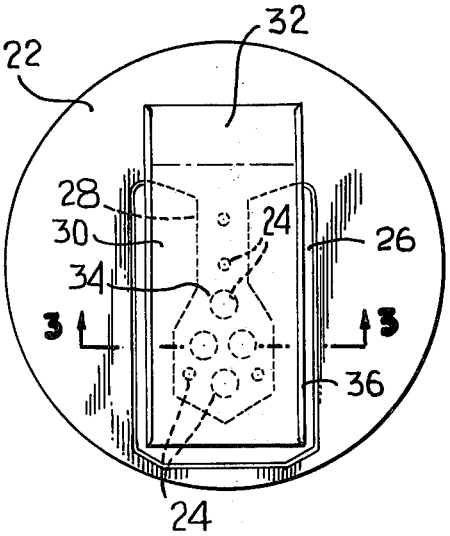
FIG. 2 is a plan view similar to FIG. 1, embodying the raised container wall sealing pattern control in accordance with the invention.
Figure 3:
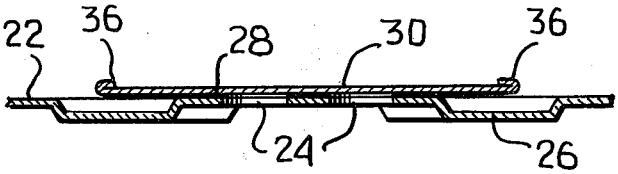
FIG. 3 is an enlarged fragmentary transverse sectional view taken generally along the line 3—3 of FIG. 2, and shows more specifically the formation of the container wall.

Referring first to FIGS. 2 and 3, it will be seen that a container wall portion 22, which corresponds to the container wall 10, has formed therein a plurality of dispensing openings 24 in the same manner as the container wall portion 10. However, as is best shown in FIG. 3, the container wall portion 22 has been modified in the area of the dispensing openings 24 by inwardly depressing the container wall portion as at 26. Then the central part of the depressed area 26 is raised to define a raised area 28. The raised area 28 has the dispensing openings formed therein.

The dispensing openings 24 are temporarily sealed by an adhesive tape or pull tape 30 in the same manner as described above with respect to FIG. 1. The rear end of the pull tape 30 is secured to the container wall portion 22 by a permanent bond 32. It is further detachably sealed to the container wall portion 22 by a detachable bond 34. The detachable bond 34 has an outline or configuration as predetermined by the raised area 28. In other words, the outline of the detachable bond 34 as shown in FIG. 2 corresponds to the outline of the raised area 28. Thus, the sealing die may be a flat die and variations in operating conditions will not influence the outline of the detachable bond 34. Accordingly, the same bond will be repeated in all such containers irrespective of operating conditions, and thus a constant peel resistance can be obtained.

It is to be noted that the pull tape 30 is of a lesser width than the depressed area 26, and as described with respect to the pull tape 14 has reversely turned edges 36 for reinforcement purposes.

Figure 4:
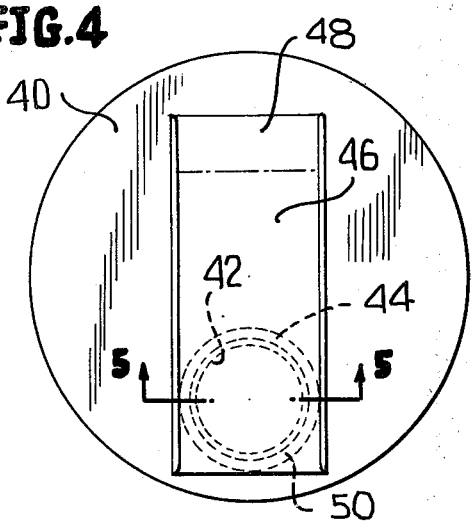
FIG. 4 is a plan view similar to FIGS. 1 and 2, and shows a modified form of the invention.
Figure 5:
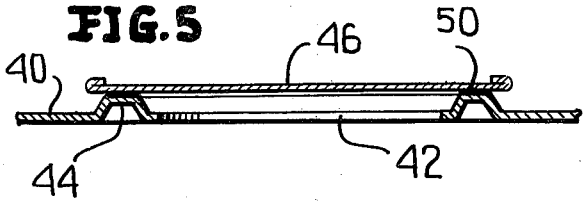
FIG. 5 is an enlarged fragmentary sectional view taken along the line 5—5 of FIG. 4, and shows specifically the raised container wall configuration.

Reference is now made to FIG. 4 wherein a modified form of easy opening container is illustrated. In FIG. 4, the container wall portion is identified by the numeral 40 and has a single dispensing opening 42 therein. In accordance with this invention, as best shown in FIG. 5, the container wall portion 40 is raised surrounding the dispensing opening 42 to define an annular raised area 44.

The dispensing opening 42 is temporarily sealed by an adhesive tape or pull tape 46 which is of a laminated construction in the same manner as defined above. The pull tape 46 has a permanent bond 48 with the container wall 40 at the rear end of the pull tape. The pull tape 46 also has a detachable bond 50 surrounding the dispensing opening 42.

It is to be understood that the configuration of the detachable bond 50 is determined by the configuration of the raised area 44. Thus, as is schematically shown in FIG. 6, the detachable bond 50 is of an annular outline and is centered on the circular dispensing opening 42.

Figure 6:
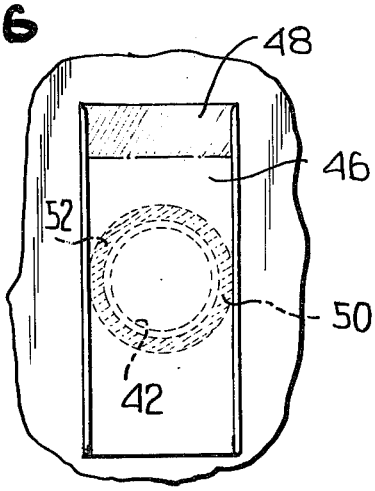
FIG. 6 is a schematic view showing the areas of bond of the pull tape.

As will be apparent from FIG. 6, the maximum width of the detachable bond 50 transversely of the pull tape 46 is in a starting area 52 and once peeling has been initiated, the peeling of the pull tape 46 from the container wall 40 surrounding the dispensing opening 42 may be readily effected. It is to be noted that the minimum width of the detachable bond 50 is generally midpoint of the dispensing opening 42.

Figure 7:
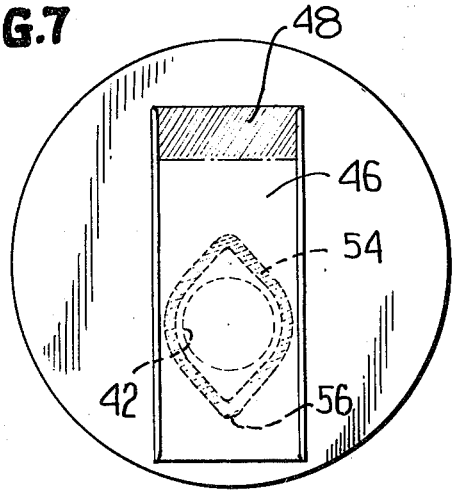
FIG. 7 is a schematic view similar to FIG. 6, but shows a different sealing pattern between the pull tape and the container wall portion surrounding the dispensing opening.

Reference is now made to FIG. 7 wherein a slight modification of the embodiment of FIG. 4 is illustrated.

The pull tape 46 has a permanent bond 48 with the container wall portion. Further, there is a detachable bond 54 between the pull tape 46 and the container wall portion surrounding the dispensing opening 42. However, the detachable bond 50, instead of being of an annular configuration, is generally oval in configuration. Further, at least a leading edge portion 56 of the detachable bond 54 is generally pointed. Thus, peeling of the pull tape to rupture the detachable bond 54 may be readily initiated with there being a momentary increase in peel resistance, after which the effective transverse width of the detachable bond 54 will gradually diminish to a minimum at the midpoint of the dispensing opening 42.

In the embodiment of FIG. 7, the rear part of the detachable bond 54 is also illustrated as being pointed so that the detachable bond 54 is of a symmetrical configuration. However, the rear portion of the detachable bond 54 may vary in outline.

It is to be understood that in accordance with this invention the outline of the detachable bond 54 is controlled by raising the container wall portion in the manner shown in FIG. 5 to define a raised area surrounding the dispensing opening 42 of a configuration corresponding to the configuration of the detachable bond 54.

Although only several preferred embodiments of the invention have been specifically illustrated and described, it is to be understood that variations may be made in the configuration of the container wall for the purpose of controlling the detachable bond configuration without departing from the spirit and scope of the invention as defined by the appended claims.

I claim:

1. In an easy opening container, a wall portion having a dispensing opening, a pull tape overlying said dispensing opening, and a peelable bond between said pull tape and said container wall portion, the improvement comprising said container wall portion having an area raised relative to a surrounding part of said wall portion, said raised area being of a size materially less than that of said wall portion and of a predetermined pattern surrounding said dispensing opening, said raised area defining the configuration and area of said peelable bond and forming means for controlling peel resistance of said peelable bond.

2. The easy opening container of claim 1 wherein said raised area has said dispensing opening formed therein.

3. The easy opening container of claim 1 wherein said raised area has said dispensing opening formed therein, and said container wall portion surrounding part is a depressed area generally surrounding said raised area and underlying said pull tape, said container wall portion including a further part surrounding said depressed area.

4. The easy opening container of claim 3 wherein said container wall portion lies in a general plane, and said raised area is generally coplanar with the general plane of said container wall portion.

5. The easy opening container of claim 4 wherein there is a permanent bond between an end portion of said pull tape and said container wall portion generally beyond said depressed area.

6. The easy opening container of claim 5 wherein said depressed area is generally U-shaped in outline.

7. The easy opening container of claim 1 wherein said raised area has a plurality of said dispensing openings therein.

8. The easy opening container of claim 1 wherein said container wall portion lies in a general plane, and said raised area is raised above the general plane of said container wall portion.

9. The easy opening container of claim 1 wherein said opening is a circular opening and said raised area is annular.

10. The easy opening container of claim 1 wherein said opening is a circular opening and said raised area is generally oval in the direction of pull tape length.

11. The easy opening container of claim 1 wherein said opening is a circular opening and said raised area is generally oval in the direction of pull tape length and has a generally pointed leading end for controlling peel resistance.

* * * * *